US007260342B2

(12) United States Patent
Nishimura

(10) Patent No.: US 7,260,342 B2
(45) Date of Patent: Aug. 21, 2007

(54) IMAGE-FORMING APPARATUS

(75) Inventor: Soichiro Nishimura, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 147 days.

(21) Appl. No.: 11/235,153

(22) Filed: Sep. 27, 2005

(65) Prior Publication Data

US 2006/0133850 A1 Jun. 22, 2006

(30) Foreign Application Priority Data

Sep. 30, 2004 (JP) ..... 2004-288281

(51) Int. Cl.
*G03G 21/18* (2006.01)
*G03G 21/16* (2006.01)

(52) U.S. Cl. ..... 399/113; 399/111

(58) Field of Classification Search ..... 399/25, 399/111, 113, 114
See application file for complete search history.

(56) References Cited

U.S. PATENT DOCUMENTS

| | | | | |
|---|---|---|---|---|
| 6,384,940 | B1 * | 5/2002 | Kawai et al. | 399/113 X |
| 6,751,428 | B2 | 6/2004 | Okabe | |
| 6,871,031 | B2 * | 3/2005 | Blaine et al. | 399/113 |
| 2003/0084645 | A1 | 5/2003 | Okabe | |
| 2004/0265000 | A1 | 12/2004 | Okabe | |

* cited by examiner

*Primary Examiner*—Sandra L. Brase
(74) *Attorney, Agent, or Firm*—Banner & Witcoff, Ltd

(57) ABSTRACT

An image-forming apparatus that includes a drum cartridge, a developer cartridge, a coupling mechanism for interlocking the drum cartridge and the developer cartridge, a releasing cam for releasing the interlock provided by the coupling mechanism, and a toner accommodating chamber for accommodating toner. When the amount of toner accommodated in the toner accommodating chamber is greater than or equal to a prescribed amount, the drum cartridge and the developer cartridge are interlocked by the coupling mechanism. When the amount of toner drops below the prescribed amount so that the chamber is empty, the releasing cam releases the interlock provided by the coupling mechanism.

20 Claims, 10 Drawing Sheets

IMAGE-FORMING APPARATUS

BACKGROUND OF THE INVENTION

1. Field of the Invention The present invention relates to an image-forming apparatus such as a laser printer.

2. Description of the Related Art

Image-forming apparatuss such as laser printers well known in the art have been conventionally provided with a process cartridge that is detachably mounted in the image-forming apparatus, wherein the process cartridge further includes a drum cartridge and a developer cartridge that is detachably mounted on the drum cartridge.

The drum cartridge includes a photosensitive drum on the surface of which electrostatic latent images are formed based on prescribed image data. The developer cartridge includes a developing roller for developing the latent image formed on the photosensitive drum into a toner image. When the developer cartridge is mounted on the drum cartridge, the developing roller contacts the photosensitive drum. During image formation, the developing roller is driven to rotate in a direction opposite that of the photosensitive drum. Specifically, when the latent image formed on the surface of the photosensitive drum rotates opposite the developing roller, toner carried on the developing roller is supplied to the latent image, developing the image into a toner image. Subsequently, the toner image is rotated opposite a transfer roller also disposed in opposition to the photosensitive drum. At this time, the toner image carried on the photosensitive drum is transferred onto a sheet of paper conveyed between the photosensitive drum and the transfer roller.

One such image-forming apparatus including a process cartridge with this construction is disclosed in Japanese Patent Application Publication No. 2003-84645. This image-forming apparatus enables the developer cartridge and drum cartridge to be mounted in or removed from the main body of the image-forming apparatus as a unit. Alternatively, the developer cartridge may also be removed alone from the main body, while the drum cartridge remains therein.

When the developer cartridge in this conventional image-forming apparatus runs out of toner before the drum cartridge has reached the end of its life, the user removes only the developer cartridge from the main body and replaces this cartridge with a new developer cartridge. However, since the developer cartridge in this conventional construction can be removed from the image-forming apparatus as a with the drum cartridge, when replacing the developer cartridge with a new cartridge, the user may mistakenly replace both the developer cartridge and the drum cartridge together and discard the older drum cartridge, even though this drum cartridge has not reached the end of its life.

SUMMARY

In view of the foregoing, it is an object of the present invention to provide an image-forming apparatus capable of preventing both the developer cartridge and drum cartridge from being replaced together when only the developer cartridge need be replaced.

To achieve the above and other objects, the present invention provides a image-forming apparatus that includes a main body, an image-carrying member cartridge, a developer cartridge, and a removal preventing unit. The image-carrying member cartridge is disposed inside the main body and having an image-carrying member. The developer cartridge is disposed inside the main body and supplying a developer to the image-carrying member. The removal preventing unit is disposed inside the main body The developer cartridge can selectively be mounted into or removed from the main body together with the image-carrying member cartridge, or mounted into or removed from the main body alone while the image-carrying member cartridge remains mounted in the main body. The removal preventing unit detects a state in which only the developer cartridge need be removed and prevents the removal of the image-carrying member cartridge from the main body based on the detection.

In another aspect of the invention, there is provided a image-forming apparatus including a main body, an image-carrying member cartridge, a developer cartridge, and a cover member. The image-carrying member cartridge is disposed inside the main body and having an image-carrying member. The developer cartridge is disposed inside the main body and supplying a developer to the image-carrying member. The cover member is disposed on the main body.

The developer cartridge can selectively be mounted into or removed from the main body together with the image-carrying member cartridge, or mounted into or removed from the main body alone while the image-carrying member cartridge remains mounted in the main body. The cover member allows the mounting and removal of only the developer cartridge while the image-carrying member cartridge remains mounted in the main body.

In another aspect of the invention, there is provided a image-forming apparatus including a main body, a first cartridge, a second cartridge, and a removal preventing unit. The first cartridge is mountable to or removable from the main body. The second cartridge includes a chamber that accommodates a developing agent, and is mountable to or removable from the first cartridge. The removal preventing unit is disposed inside the main body.

The second cartridge can selectively be mounted into or removed from the main body together with the first cartridge, or mounted into or removed from the casing alone while the first cartridge remains mounted in the main body. The removal preventing unit detects a state in which only the second cartridge need be removed and prevents the removal of the first cartridge from the casing based on the detection.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE PREFERRED EMBODIMENTS

Figure 1:
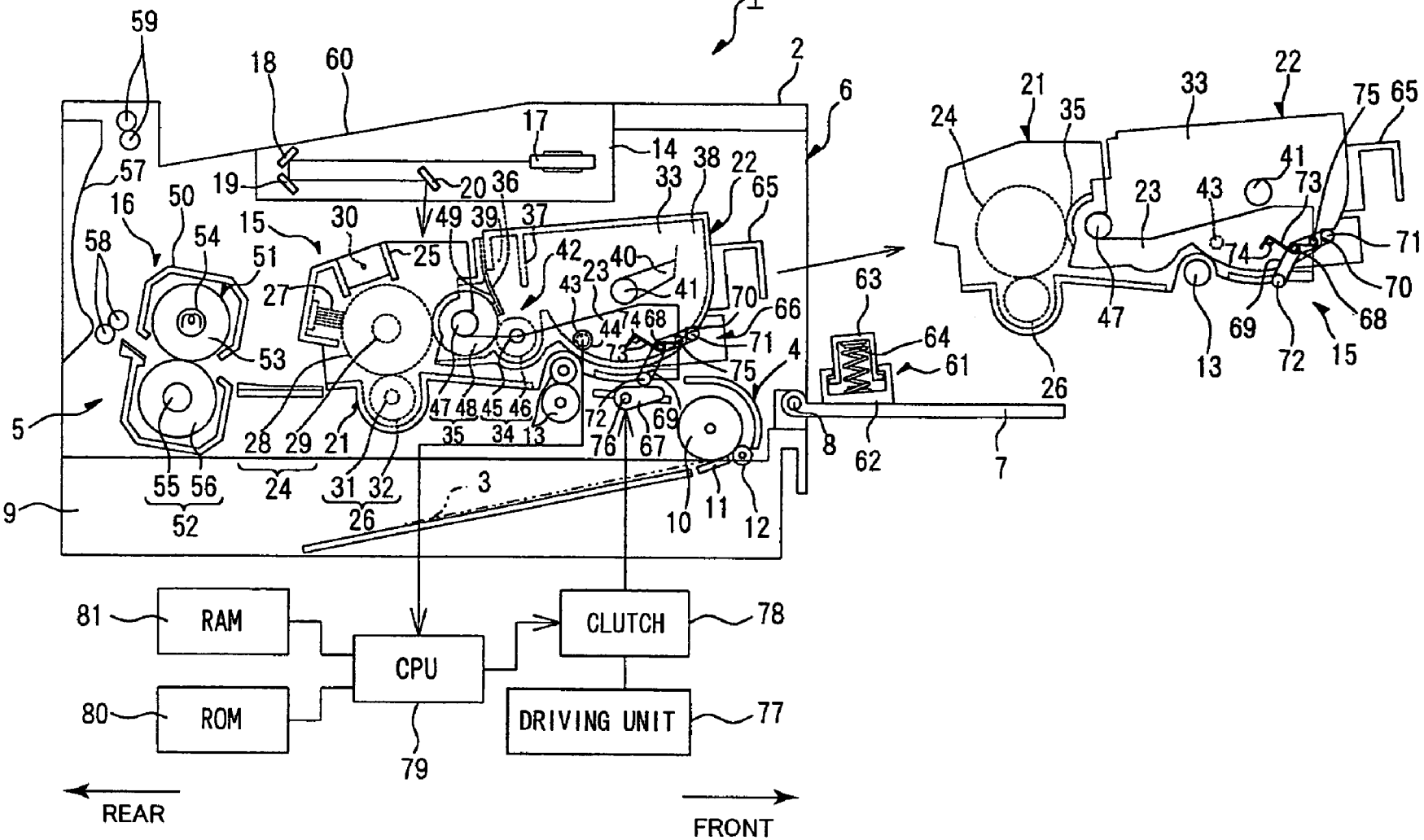
FIG. 1 is a cross-sectional view of a laser printer according to a first embodiment of the present invention, wherein a developer cartridge and a drum cartridge have been removed together from a main casing.
Figure 2:
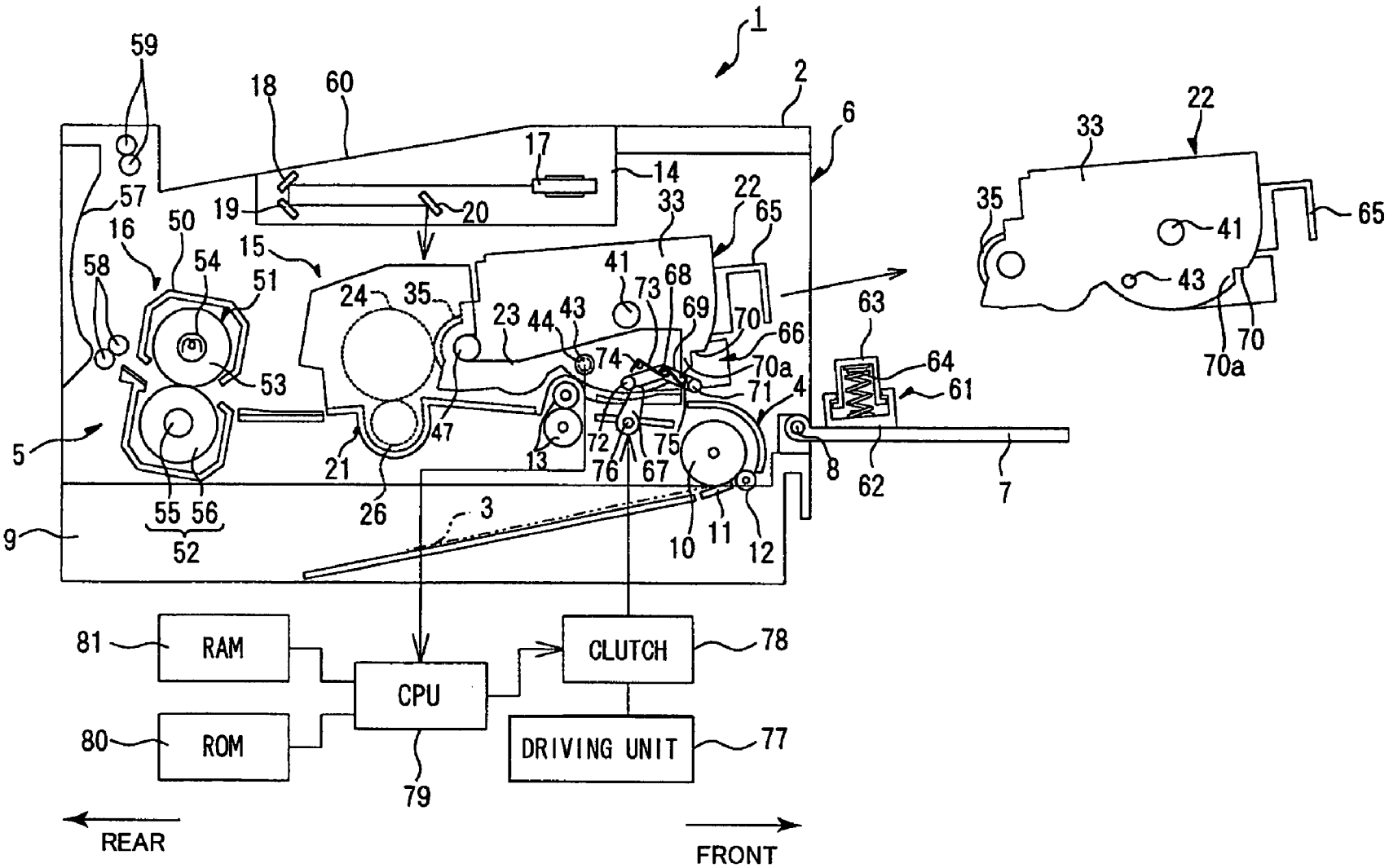
FIG. 2 is a cross-sectional view of the laser printer in FIG. 1, wherein the developer cartridge has been removed from the main casing by itself while the drum cartridge remains in the main casing.

An image-forming apparatus according to a first embodiment of the present invention will be described with reference to FIGS. 1 and 2, wherein the present invention is applied to a laser printer. FIGS. 1 and 2 are side cross-sectional views of a laser printer 1.

As shown in the drawings, the laser printer 1 includes a main casing 2, and, within the main casing 2, a feeder unit 4 for feeding sheets of a paper 3, an image-forming unit 5 for forming images on the paper 3 supplied from the feeder unit 4. The laser printer 1 also includes an access opening 6 formed in one end wall of the main casing 2 for inserting and removing a process cartridge 15 described later, and a front cover 7 capable of opening and closing over the access opening 6.

The front cover 7 is rotatably supported on a cover shaft 8 inserted through a bottom end of the front cover 7. Accordingly, when the front cover 7 is rotated counterclockwise in FIGS. 1 and 2 about the cover shaft 8, the front cover 7 covers the access opening 6. When the front cover 7 is rotated clockwise about the cover shaft 8, the access opening 6 is exposed, enabling the process cartridge 15 to be mounted into or removed from the main casing 2 through the access opening 6.

Hereinafter, the side of the laser printer 1 and process cartridge 15 on which the front cover 7 is provided will be referred to as the "front side" and the opposite side as the "rear side."

A pressing member 61 is provided on the inner surface of the front cover 7 (the rear surface when the front cover 7 is closed). The pressing member 61 includes a fixed part 62, a pressing part 63, and a coil spring 64. The fixed part 62 is fixed to the inner surface of the front cover 7. The pressing part 63 is engaged with the fixed part 62 so as to be able to contact and separate from the fixed part 62. The coil spring 64 is interposed between the fixed part 62 and pressing part 63 in a compressed state. When the front cover 7 is rotated closed, the pressing part 63 contacts a front surface of a casing 33 of a developer cartridge 22 described later. The urging force of the coil spring 64 presses the casing 33 toward a drum cartridge 21 also described later.

The feeder unit 4 includes a paper supply tray 9, a feeding roller 10 and a separating pad 11, a paper dust roller 12, and registration rollers 13. The paper supply tray 9 is disposed in a lower section of the main casing 2 for accommodating stacked sheets of the paper 3. The feeding roller 10 and separating pad 11 are disposed above the front end of the paper supply tray 9. The separating pad 11 contacts the feeding roller 10 from below. A spring (not shown) is disposed on the underside (lower side) of the separating pad 11 for pressing the separating pad 11 toward the feeding roller 10. The paper dust roller 12 is disposed in opposition to the feeding roller 10 on the lower front side thereof. The registration rollers 13 are disposed rearward of the feeding roller 10. The registration rollers 13 include a pair of rollers disposed in confrontation.

The topmost sheet of the paper 3 stacked in the paper supply tray 9 is pressed against the feeding roller 10. As the feeding roller 10 rotates, the cooperative operations of the feeding roller 10 and the separating pad 11 reliably separate the sheets of paper 3 so that the feeding roller 10 feeds the paper 3 one sheet at a time. When the paper 3 is fed to the paper dust roller 12, the paper dust roller 12 conveys the sheet of paper 3 to the registration rollers 13 while removing paper dust from the sheet.

After adjusting the registration of the paper 3, the registration rollers 13 convey the sheet of paper 3 to a transfer position in the image-forming unit 5 (a nip position between a photosensitive drum 24 and a transfer roller 26 described later, at which position a toner image carried on the photosensitive drum 24 is transferred to the paper 3).

The image-forming unit 5 includes a scanning unit 14, the process cartridge 15, and a fixing unit 16. The scanning unit 14 is disposed in an upper section of the main casing 2 and includes a laser light source (not shown), a polygon mirror 17 that can be driven to rotate, reflecting mirrors 18, 19, and 20. The laser light source emits a laser beam, based on image data. After the laser beam is deflected off the polygon mirror 17, the reflecting mirrors 18, 19, and 20 bend the optical path of the laser beam until the laser beam is traveling downward. In this way, the laser beam is irradiated over the surface of the photosensitive drum 24 in a high-speed scan.

The process cartridge 15 is detachably mounted in the main casing 2 beneath the scanning unit 14. As mentioned earlier, the process cartridge 15 includes the drum cartridge 21, and the developer cartridge 22 that is detachably mounted on the drum cartridge 21.

The drum cartridge 21 includes a pair of side plates 23 extending in the front-to-rear direction and confronting each other in a direction orthogonal to the front-to-rear direction (hereinafter referred to simply as the "widthwise direction"). The developer cartridge 22 is mounted on the front side of the drum cartridge 21 between the side plates 23. On the rear side of the drum cartridge 21 are provided the photosensitive drum 24, a Scorotron charger 25, the transfer roller 26, and a cleaning brush 27.

The photosensitive drum 24 includes a main drum body 28 that is cylindrical in shape and has a positive charging photosensitive layer formed by polycarbonate or the like on its outer surface, and a metal drum shaft 29 extending along the axial center of the main drum body 28 in the longitudinal direction thereof. The metal drum shaft 29 is fixed in both side plates 23 of the drum cartridge 21, while the main drum body 28 is rotatably supported on the metal drum shaft 29. With this construction, the photosensitive drum 24 is disposed between the side plates 23 and is capable of rotating about the metal drum shaft 29.

The Scorotron charger 25 is disposed diagonally above and rearward of the photosensitive drum 24 in opposition to but separated a prescribed distance from the photosensitive drum 24 so as not to contact the same. The Scorotron charger 25 is a positive charging Scorotron charger that generates a corona discharge from a charging wire 30 formed of tungsten or the like. The Scorotron charger 25 can form a uniform charge of positive polarity over the surface of the photosensitive drum 24.

The transfer roller 26 is rotatably supported on both side plates 23 of the drum cartridge 21 and contacts the lower side of the photosensitive drum 24 so as to form a nip part with the photosensitive drum 24. The transfer roller 26 is configured of a metal roller shaft 31 that is covered with a roller 32 formed of an electrically conductive rubber material. The metal roller shaft 31 is fixed between both side plates 23 with the roller 32 covering the metal roller shaft 31 so as to be capable of rotating with respect to the metal roller shaft 31. During a transfer operation, a transfer bias is applied to the transfer roller 26.

The cleaning brush 27 is disposed rearward of the photosensitive drum 24 so that a tip of the brush is in contact with the surface of the main drum body 28 on the photosensitive drum 24.

The developer cartridge 22 includes the casing 33, a supply roller 34, a developing roller 35, and a thickness-regulating blade 36. The casing 33 is formed in a box shape that is open on the rear side. The supply roller 34, developing roller 35, and thickness-regulating blade 36 are disposed inside the casing 33.

A grip part 65 is provided on the front surface of the casing 33. The grip part 65 has a box shaped cross-section that is open on the bottom. A partitioning plate 37 is provided inside the casing 33, protruding downward from the top surface of the casing 33 and extending along the width of the casing 33. The partitioning plate 37 partitions the space inside the casing 33 to form a toner-accommodating chamber 38 on the front side of the partitioning plate 37 and a developing chamber 39 on the rear side.

The toner-accommodating chamber 38 is filled with a nonmagnetic, single-component toner having a positive charge. The toner used in the preferred embodiment is a polymerized toner obtained by copolymerizing a polymerized monomer using a well-known polymerization method, such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

A rotational shaft 41 is supported in the toner-accommodating chamber 38, extending through the central region of the toner-accommodating chamber 38 in the widthwise direction. An agitator 40 is provided on the rotational shaft 41. The agitator 40 rotates to stir the toner in the toner-accommodating chamber 38, discharging some of the toner into the developing chamber 39 through a discharge opening 42 formed beneath the partitioning plate 37.

Windows 43 are provided in the casing 33 for detecting when the amount of toner remaining in the toner-accommodating chamber 38 is less than a prescribed amount. A sensor 44 is disposed near the windows 43 for detecting when the amount of toner in the toner-accommodating chamber 38 has dropped below the prescribed amount, that is, when the toner-accommodating chamber 38 is in an empty state. When the sensor 44 detects that the toner-accommodating chamber 38 is in an empty state, the sensor 44 outputs an empty signal to a CPU 79 described later. The empty signal is cleared when the old developer cartridge 22 is replaced with a new developer cartridge 22.

The supply roller 34 is disposed in the bottom front area of the developing chamber 39 and is rotatably supported between both side plates of the casing 33 that oppose each other in the widthwise direction. The supply roller 34 includes a metal roller shaft 45 extending in the widthwise direction, and a sponge roller 46 formed of an electrically conductive foam material that covers the metal roller shaft 45.

The developing roller 35 is disposed in the lower rear area of the developing chamber 39 and is rotatably supported between both side plates of the casing 33. The developing roller 35 is also positioned so that a portion protrudes rearward from the casing 33 so as to be exposed outside of the casing 33. With this construction, when the developer cartridge 22 is mounted on the drum cartridge 21 and the front cover 7 is closed, the pressing member 61 presses the casing 33 toward the drum cartridge 21 so that the part of the developing roller 35 exposed from the casing 33 presses against the photosensitive drum 24.

The developing roller 35 includes a metal roller shaft 47, and a rubber roller 48 formed of an electrically conductive rubber material that covers the periphery of the metal roller shaft 47. The rubber roller 48 is configured of an electrically conductive urethane rubber or silicon rubber including fine carbon particles or the like, the surface of which is coated with a urethane rubber or silicon rubber including fluorine. The rubber roller 48 contacts the sponge roller 46 of the supply roller 34 so that the sponge roller 46 and rubber roller 48 are compressed together.

The thickness-regulating blade 36 includes a metal leaf spring member, and a rubber-pressing member 49 provided on the end of the leaf spring member. The rubber-pressing member 49 has a semicircular cross-section and is formed of an insulating silicon rubber. The thickness-regulating blade 36 is supported on the casing 33 above the developing roller 35 so that the lower end of the thickness-regulating blade 36 opposes the front side of the rubber roller 48. With this construction, the elastic force of the thickness-regulating blade 36 causes the rubber-pressing member 49 to contact the rubber roller 48 with pressure.

Toner discharged through the discharge opening 42 into the developing chamber 39 by the rotating agitator 40 is supplied onto the rubber roller 48 of the developing roller 35 by the rotating supply roller 34. At this time, the toner is positively tribocharged between the sponge roller 46 of the supply roller 34 and the rubber roller 48 of the developing roller 35. As the developing roller 35 rotates, toner supplied to the surface of the rubber roller 48 passes between the rubber roller 48 and the rubber-pressing member 49 of the thickness-regulating blade 36, thereby maintaining a uniform thickness of toner on the rubber roller 48.

In the meantime, the Scorotron charger 25 charges the surface of the photosensitive drum 24 with a uniform positive polarity. Subsequently, the scanning unit 14 irradiates a laser beam onto the charged surface of the photosensitive drum 24 in a high speed scan to form an electrostatic latent image on the photosensitive drum 24 based on image data.

Next, positively charged toner carried on the surface of the rubber roller 48 comes into contact with the photosensitive drum 24 as the developing roller 35 rotates and is supplied to areas on the surface of the positively charged photosensitive drum 24 that were exposed to the laser beam and, therefore, have a lower potential. In this way, the latent image on the photosensitive drum 24 is transformed into a visible image so that a reverse toner image is carried on the surface of the photosensitive drum 24.

Subsequently, the photosensitive drum 24 and transfer roller 26 are driven to rotate in order to convey a sheet of paper 3 that becomes interposed therebetween. As the paper 3 is conveyed between the photosensitive drum 24 and transfer roller 26, the toner image carried on the surface of the photosensitive drum 24 is transferred onto the paper 3.

During the transfer process, paper dust is deposited on the surface of the photosensitive drum 24 through contact with the paper 3. After the transfer process, the cleaning brush 27 removes this paper dust from the photosensitive drum 24 as the photosensitive drum 24 rotates opposite the cleaning brush 27.

The fixing unit 16 includes a fixed frame 50, a heating roller 51, and a pressure roller 52. The fixed frame 50 is disposed on the rear side of the process cartridge 15 and extends in the widthwise direction. The heating roller 51 and pressure roller 52 are rotatably supported in the fixed frame 50 and confront each other vertically.

The heating roller 51 includes a metal tube 53 and a halogen lamp 54 disposed inside the metal tube 53 for heating the same. The heating roller 51 is driven to rotate by a driving force inputted from a motor (not shown).

The pressure roller 52 is disposed below and in opposition to the heating roller 51 and contacts the heating roller 51 with pressure. The pressure roller 52 is configured of a metal roller shaft 55 covered with a roller 56 that is formed of a rubber material. The pressure roller 52 follows the rotational drive of the heating roller 51. A pair of conveying rollers 58 is provided rearward of the fixed frame 50. A discharge path 57 extends vertically near the rear wall of the main casing 2 above the conveying rollers 58. A pair of discharge rollers 59 is disposed in front of the top end of the discharge path 57. A discharge tray 60 is provided on the top of the main casing 2.

In the fixing unit 16, toner transferred onto the paper 3 is fixed to the paper 3 by heat as the paper 3 passes between the heating roller 51 and pressure roller 52. After the fixing process, the heating roller 51 and pressure roller 52 continue conveying the paper 3 toward the conveying rollers 58; the conveying rollers 58 convey the paper 3 along the discharge path 57 to the discharge rollers 59; and the discharge rollers 59 provided on the top end of the discharge path 57 discharge the paper 3 onto the discharge tray 60 formed on the top surface of the main casing 2.

In the laser printer 1 of the preferred embodiment, the developer cartridge 22 can be mounted into or removed from the main casing 2 together with the drum cartridge 21. In addition, the developer cartridge 22 can be mounted into or removed from the main casing 2 alone while the drum cartridge 21 remains mounted in the main casing 2. The laser printer 1 also includes a coupling mechanism 66 for coupling the drum cartridge 21 and developer cartridge 22 together, and a release cam 67 for disengaging the link between the drum cartridge 21 and developer cartridge 22 formed by the coupling mechanism 66. The sensor 44 and the release cam 67 serve as a removal preventing unit for detecting a state in which only the developer cartridge 22 need be removed and preventing the removal of the drum cartridge 21 from the main casing 44 based on the detection of the sensor 44.

The coupling mechanism 66 includes pivoting shafts 68, coupling arms 69, a depression 70, and an arm-urging spring 73. The pivoting shafts 68 protrudes from the front ends of the side plates 23 of the drum cartridge 21 outward in the widthwise direction. The coupling arms 69 are pivotably supported on the pivoting shafts 68. The depression 70 is formed in the lower part on the front side of the casing 33 spanning the widthwise direction. A protrusion **70*a* (see FIG. 2) is formed on the lower side of the depression 70**.

Each of the coupling arms 69 is bent in a substantial V-shape, and each of the pivoting shafts 68 is inserted through the respective bent portion. An engaging protrusion 71 is provided on the front end of each coupling arm 69 and protrudes inward in the widthwise direction. The engaging protrusion 71 engages with the protrusion **70*a* when the drum cartridge 21 and developer cartridge 22 are coupled together. A contact part 72 is provided on the rear end of the coupling arm 69 for contacting the peripheral surface of the release cam 67. The arm-urging spring 73 urges the coupling arm 69 in a direction for engaging the engaging protrusion 71 in the depression 70 (counterclockwise in FIGS. 1 and 2**).

The arm-urging spring 73 is formed by winding a wire about each pivoting shaft 68. One end of the arm-urging spring 73 is engaged in a first spring engaging part 74 provided on the side plate 23 of the drum cartridge 21. The other end of the arm-urging spring 73 is engaged in a second spring engaging part 75 provided on the coupling arm 69 near the engaging protrusion 71. The arm-urging spring 73 has an urging force for rotating the coupling arm 69 counterclockwise in FIGS. 1 and 2. Hence, the coupling arm 69 is constantly urged in a direction for engaging the engaging protrusion 71 in the depression 70.

When the process cartridge 15 is mounted in the main casing 2, a rotational shaft 76 extending in the widthwise direction is rotatably disposed diagonally below and to the rear of the coupling arm 69. The release cam 67 is supported on the rotational shaft 76. The release cam 67 is substantially egg-shaped in a side view, tapering toward the end farthest from the rotational shaft 76. As the release cam 67 rotates about the rotational shaft 76, the peripheral surface of the release cam 67 alternately and repeatedly contacts and separates from the contact part 72 of the coupling arm 69.

The laser printer 1 also includes a drive unit 77, a clutch 78, the CPU 79, a ROM 80, and a RAM 81. The drive unit 77 generates a force for rotating the release cam 67. The clutch 78 switches between the transmission and interruption of the rotational force supplied from the drive unit 77 to the rotational shaft 76. The CPU 79 controls the clutch 78. The ROM 80 and the RAM 81 are connected to the CPU 79. The sensor 44 is configured to input an empty signal into the CPU 79.

The ROM 80 stores a program that the CPU 79 requires for controlling the clutch 78. The RAM 81 serves as a work area for the CPU 79 to execute the program stored in the ROM 80. Hence, the CPU 79 controls the clutch 78 based on an empty signal inputted from the sensor 44 to control the transmission and interruption of the rotational force to the release cam 67.

When an empty signal has not been inputted from the sensor 44 into the CPU 79, the release cam 67 is halted in a rotational position in which the peripheral surface of the release cam 67 is separated from the contact part 72 of the coupling arm 69, or a rotational position in which the peripheral surface contacts but does not press against the contact part 72. Accordingly, the engaging protrusion 71 of the coupling arm 69 is engaged in the depression 70 by the urging force of the arm-urging spring 73 or, more specifically, the engaging protrusion 71 is engaged in the protrusion 70*a*, and the developer cartridge 22 is coupled to the drum cartridge 21.

When the amount of toner in the toner-accommodating chamber 38 drops below a prescribed amount, the sensor 44 inputs an empty signal into the CPU 79. Upon receiving the empty signal, the CPU 79 controls the clutch 78 to transmit the rotational force from the drive unit 77 to the rotational shaft 76, causing the release cam 67 to rotate counterclockwise in FIG. 1. As the release cam 67 rotates, the peripheral surface of the release cam 67 contacts the contact part 72 of the coupling arm 69, pushing the contact part 72 upward. When the contact part 72 is pushed upward, the coupling arm 69 pivots about the pivoting shafts 68, moving the engaging protrusion 71 of the coupling arm 69 downward. The engaging protrusion 71 then separates from the depression 70, disengaging the coupling arm 69 and uncoupling the drum cartridge 21 and developer cartridge 22, as shown in FIG. 2.

After the release cam 67 has rotated to a position in which the engaging protrusion 71 separates from the depression 70, the CPU 79 controls the clutch 78 to interrupt transmission of the rotational force from the drive unit 77 to the rotational shaft 76. Hence, the drum cartridge 21 and developer cartridge 22 remain in a disengaged state. At this time, if the user grips the grip part 65 and pulls on the process cartridge 15, the developer cartridge 22 can be removed alone from the main casing 2 while the drum cartridge 21 remains therein.

If a new developer cartridge 22 is mounted in the main casing 2 after removing the old developer cartridge 22 by itself, the empty signal transmitted from the sensor 44 to the CPU 79 is cleared. At this time, the CPU 79 controls the clutch 78 to transmit the rotational force from the drive unit 77 to the rotational shaft 76, causing the release cam 67 to rotate clockwise in FIG. 2. As the release cam 67 rotates, the peripheral surface of the release cam 67 separates from the contact part 72 of the coupling arm 69, allowing the urging force of the arm-urging spring 73 to engage the engaging protrusion 71 of the coupling arm 69 in the depression 70 and couple the developer cartridge 22 to the drum cartridge 21.

Subsequently, the CPU 79 controls the clutch 78 to interrupt transmission of the rotational force from the drive unit 77 to the rotational shaft 76. The release cam 67 halts in a rotational position in which the peripheral surface of the release cam 67 is separated from the contact part 72 or is contacting but not pressing against the contact part 72. Hence, the drum cartridge 21 and developer cartridge 22 can be maintained in a coupled state. In this state, if the user grips the grip part 65 and pulls on the process cartridge 15, the drum cartridge 21 and developer cartridge 22 can be removed as a unit from the main casing 2.

In the laser printer 1 of the preferred embodiment described above, the linkage between the drum cartridge 21 and developer cartridge 22 by the coupling mechanism 66 is released when the toner-accommodating chamber 38 reaches an empty state, that is, when the amount of toner in the toner-accommodating chamber 38 falls below a prescribed amount. As a result, the developer cartridge 22 can be removed from the main casing 2 alone, while leaving the drum cartridge 21 inside the main casing 2. Hence, the laser printer 1 of the preferred embodiment can prevent the user from mistakenly replacing the drum cartridge 21 and developer cartridge 22 together when only the developer cartridge 22 need be replaced.

Further, the drum cartridge 21 and developer cartridge 22 can be reliably engaged and disengaged through a simple structure of the coupling mechanism 66 that includes the coupling arm 69 and depression 70.

Further, the drum cartridge 21 and developer cartridge 22 are coupled together when the release cam 67 tilts the coupling arm 69, causing the engaging protrusion 71 of the coupling arm 69 to engage in the depression 70 of the developer cartridge 22. The drum cartridge 21 and developer cartridge 22 are disengaged when the release cam 67 tilts the coupling arm 69 so that the engaging protrusion 71 separates from the depression 70. Hence, the engaging protrusion 71 of the coupling arm 69 can be reliably engaged in and separated from the depression 70 by pivoting the coupling arm 69, thereby achieving a reliable engagement and disengagement between the drum cartridge 21 and developer cartridge 22.

Further, the coupling arm 69 is provided on both side plates 23 of the drum cartridge 21, while the depression 70 having a simpler structure that the coupling arm 69 is formed in the developer cartridge 22. Hence, this configuration can reduce the cost of the developer cartridge 22, which is replaced more frequently than the drum cartridge 21. Further, the release cam 67, which functions to release the engagement of the coupling mechanism 66 between the drum cartridge 21 and developer cartridge 22, is provided on the main casing 2 rather than on the drum cartridge 21 and developer cartridge 22. Therefore, it is possible to further reduce the costs of the drum cartridge 21 and developer cartridge 22.

Further, when a force is applied to the developer cartridge 22 for removing the developer cartridge 22 from the main casing 2 while the drum cartridge 21 and developer cartridge 22 are coupled together, the front surface of the casing 33 contacts the engaging protrusion 71 of the coupling arm 69 and pushes the engaging protrusion 71 forward. Hence, the force applied to the developer cartridge 22 for removing the developer cartridge 22 from the main casing 2 is transferred to the drum cartridge 21 via the engaging protrusion 71, coupling arm 69, and pivoting shafts 68. As a result, when the drum cartridge 21 and developer cartridge 22 are coupled together, the drum cartridge 21 can be reliably removed from the main casing 2 together with the developer cartridge 22.

Figure 3:
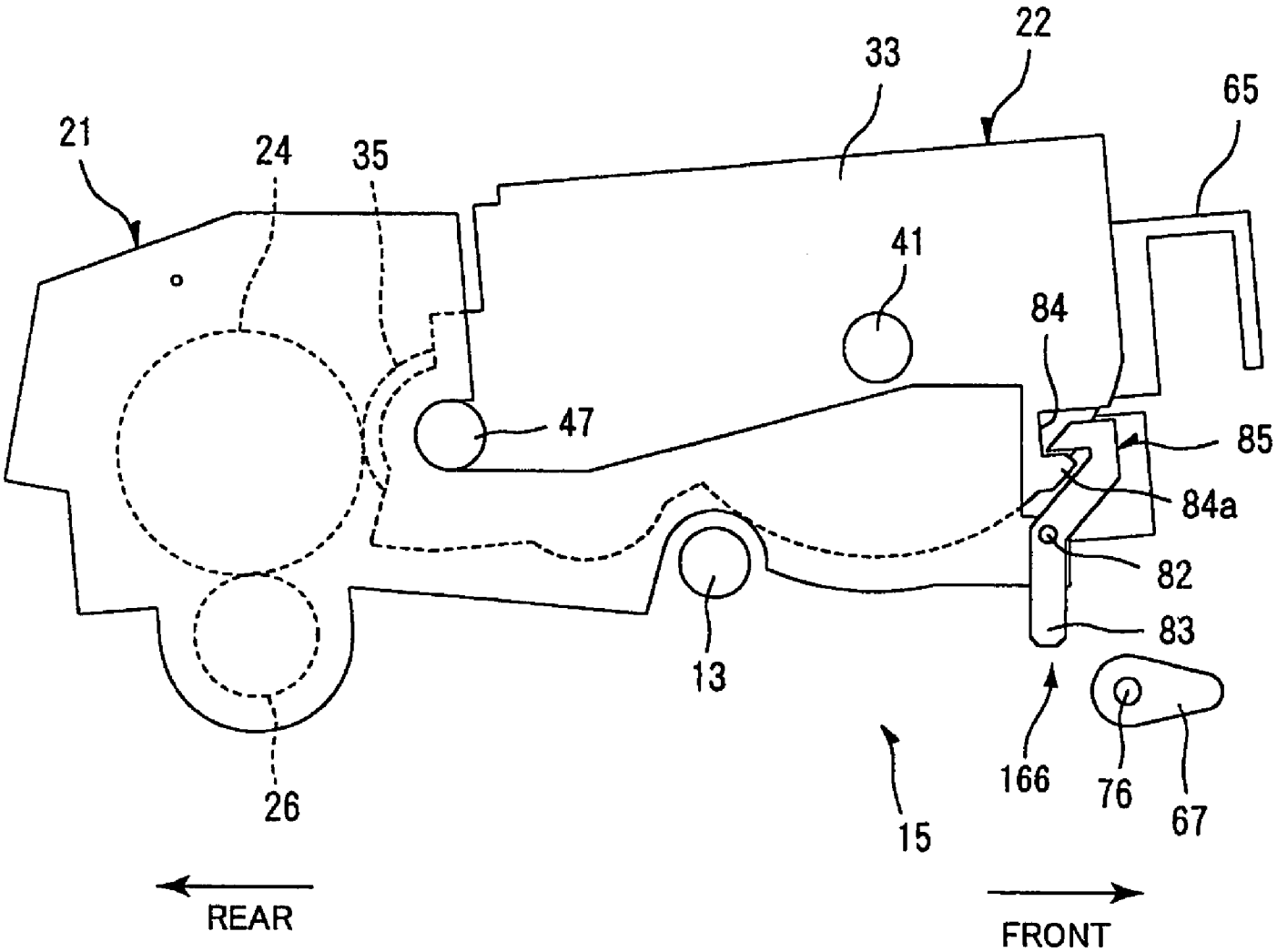
FIG. 3 is a side view illustrating a coupling mechanism and a process cartridge in a laser printer according to a second embodiment of the present invention, wherein the drum cartridge and developer cartridge are in a coupled state.
Figure 4:
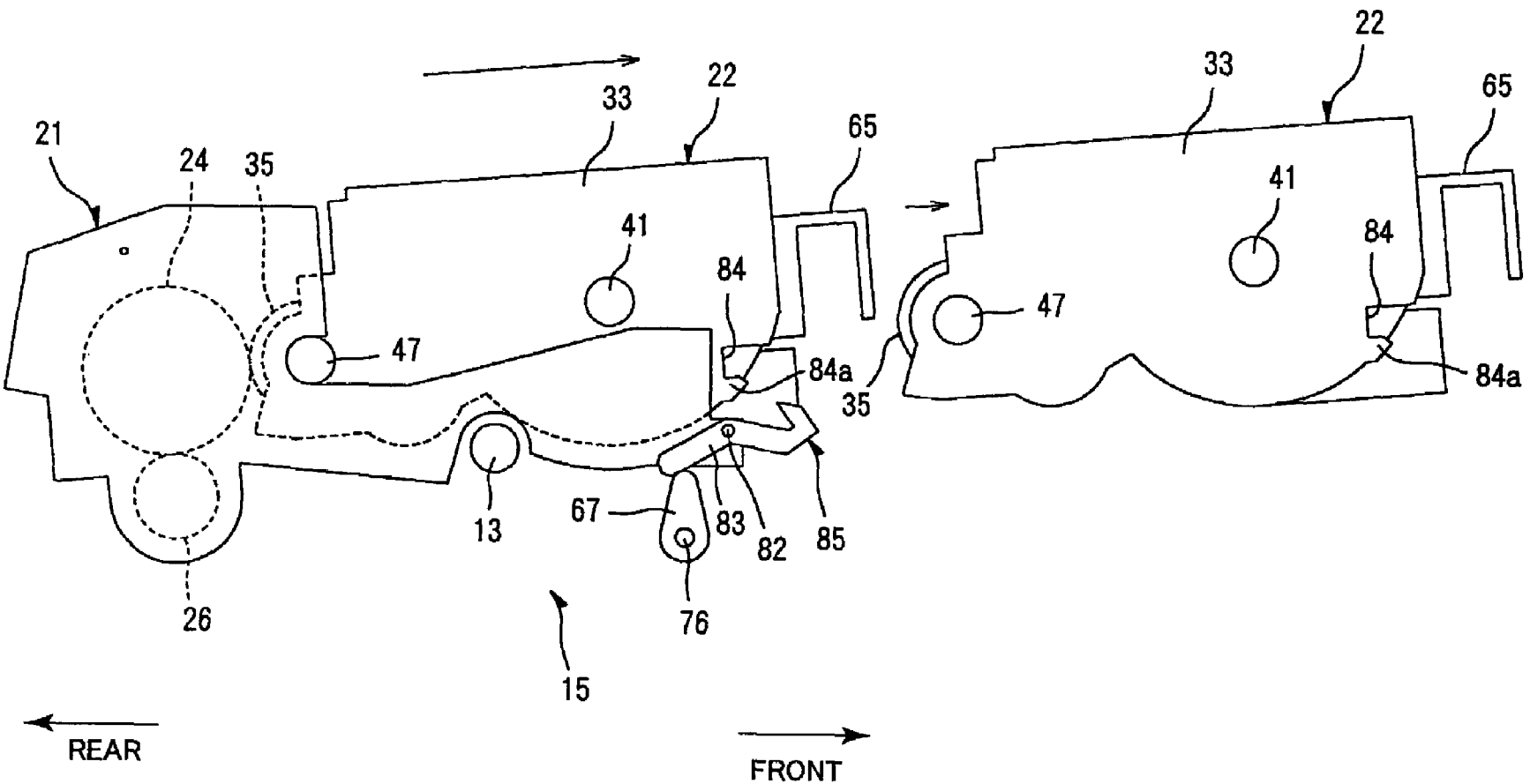
FIG. 4 is a side view showing the coupling mechanism and the process cartridge of FIG. 3, wherein the developer cartridge has been disengaged from the drum cartridge.

Next, a laser printer according to a second embodiment of the present invention will be described with reference to FIGS. 3 and 4, wherein like parts and components in the described embodiment are designated with the same reference numerals to avoid duplicating description. FIGS. 3 and 4 show only the drum cartridge 21 and developer cartridge 22 of the laser printer. The remaining structure of the laser printer is identical to that described in the first embodiment.

In the second embodiment, the coupling mechanism 166 includes pivoting shafts 82, coupling arms 83, and depressions 84. The pivoting shafts 82 protrude outward in the widthwise direction from the front end of each side plates 23. The coupling arms 83 are pivotably supported on each pivoting shaft 82. The depressions 84 are formed in a lower part on the front side of the casing 33 at both widthwise ends thereof. A protrusion 84*a* is formed on the bottom of each depression 84.

The coupling arm 83 is bent in a substantial V-shape, and the pivoting shaft 82 is inserted through the bent portion. The coupling arm 83 has an end 85 formed in a hook shape.

The hook-shaped end 85 is capable of engaging with and separating from the depression 84. In addition, an arm-urging spring (not shown) constantly urges each of the coupling arms 83 in a direction for engaging the end 85 in the depression 84 (counterclockwise in FIGS. 3 and 4). The drum cartridge 21 and developer cartridge 22 are coupled together by engaging the end 85 in the protrusion 84*a*.

When the process cartridge 15 is mounted in the main casing 2, the release cam 67 is positioned diagonally below and in front of the coupling arm 83. By rotating the release cam 67 about the rotational shaft 76 to the position shown in FIG. 4, the peripheral surface of the release cam 67 contacts and pivots the coupling arm 83 when the process cartridge 15 is pulled outward. In other words, the release cam 67 is rotated counterclockwise in FIG. 3 and halted when its tapered end is facing upward.

If the user grips the grip part 65 and pulls on the process cartridge 15 at this time, the peripheral surface of the release cam 67 will contact the lower end of the coupling arm 83 on the front side, moving this lower end rearward as the process cartridge 15 is pulled outward. Hence, the coupling arm 83 pivots in the clockwise direction of FIG. 3. As a result, the end 85 of the coupling arm 83 separates from the depression 84, as shown in FIG. 4, releasing the engagement between the drum cartridge 21 and developer cartridge 22. Hence, the developer cartridge 22 can be disengaged from the drum cartridge 21 while pulling the process cartridge 15 so that only the developer cartridge 22 is removed from the main casing 2, while the drum cartridge 21 remains therein.

With this construction, it is possible to keep the end 85 of the coupling arm 83 engaged in the depression 84 to maintain the coupling between the drum cartridge 21 and developer cartridge 22 or to separate the end 85 from the depression 84 to release the engagement between the drum cartridge 21 and developer cartridge 22 by controlling the rotational position of the release cam 67. Therefore, the effects obtained by the second embodiment are identical to those described in the first embodiment.

Next, a laser printer according to a third embodiment of the present invention will be described with reference to FIGS. 5 and 6, wherein like parts and components in the described embodiments are designated with the same reference numerals to avoid duplicating description.

Figure 5:
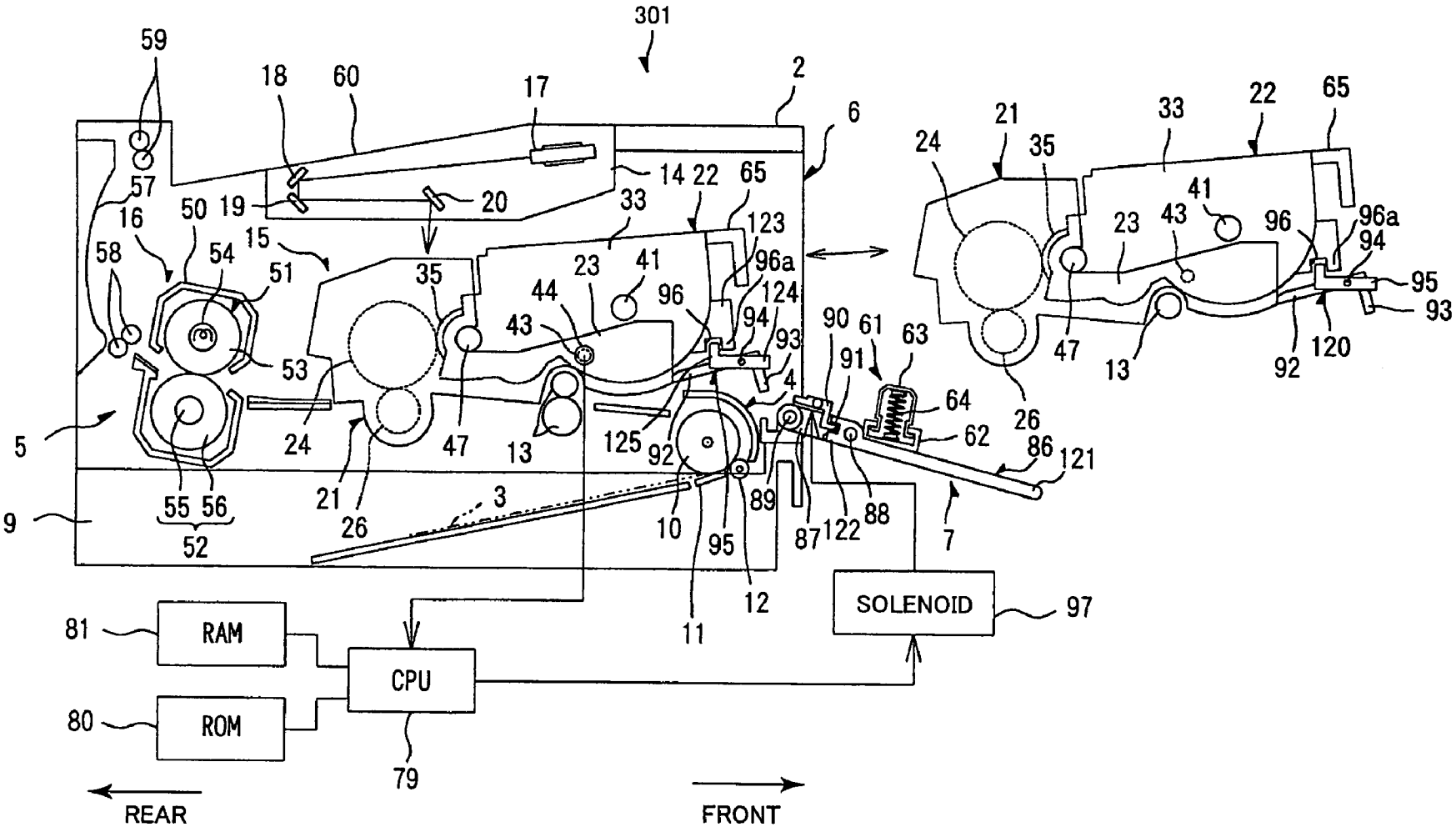
FIG. 5 is a cross-sectional view showing a laser printer according to a third embodiment of the present invention, wherein the developer cartridge and the drum cartridge have been removed together from the main casing.
Figure 6:
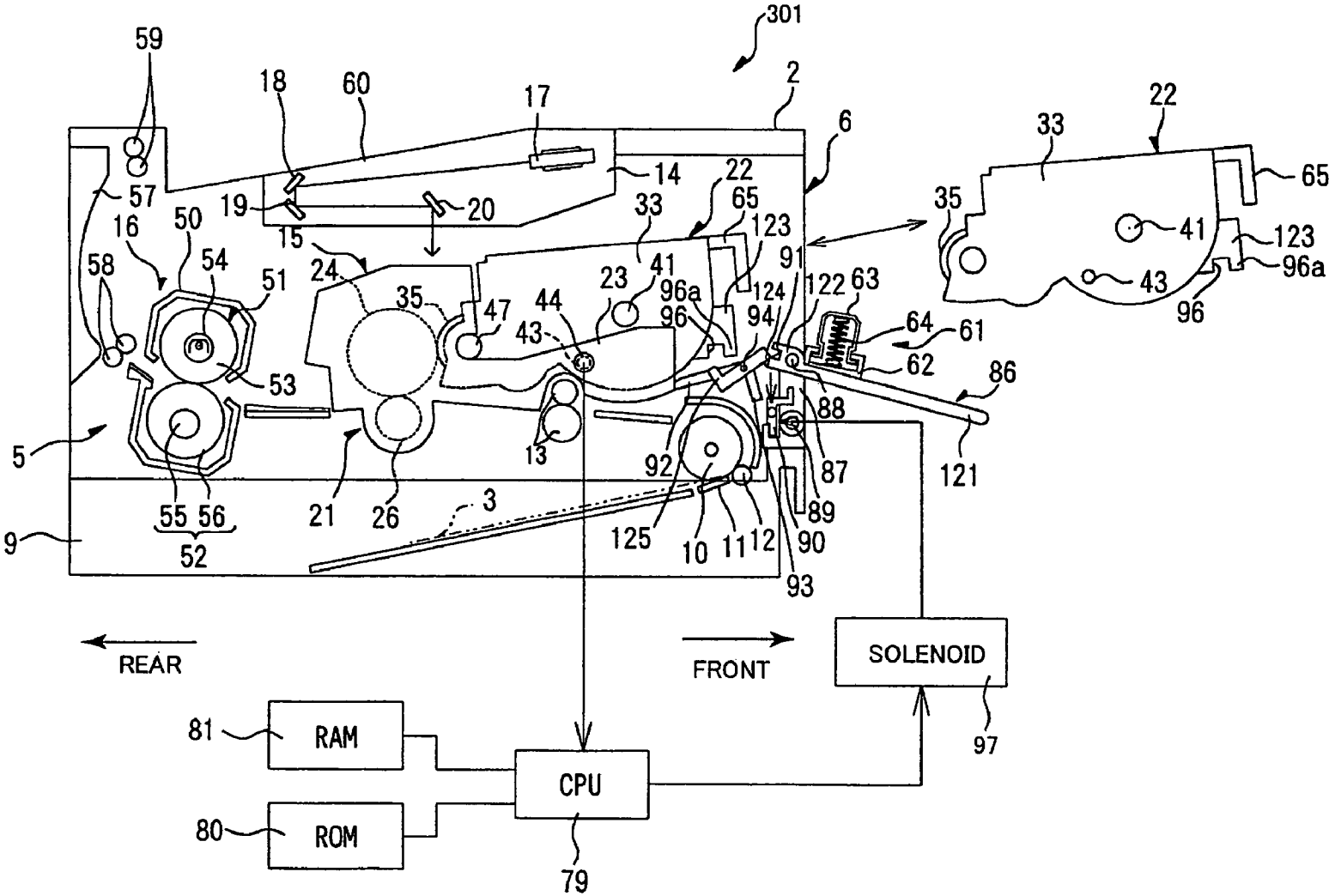
FIG. 6 is a cross-sectional view of the laser printer in FIG. 5, wherein the developer cartridge has been removed from the main casing by itself while the drum cartridge remains in the main casing.

FIGS. 5 and 6 show the structure of a laser printer 301 according to the third embodiment. In the laser printer 301, the front cover 7 includes a first cover part 86, a second cover part 87, a coupling member 90, and a solenoid 97. The second cover part 87 is positioned below the first cover part 86 when the front cover 7 is closed over the access opening 6. The coupling member 90 couples the first cover part 86 with the second cover part 87. The solenoid 97 is connected to the coupling member 90.

A first cover shaft 88 extending in the widthwise direction is inserted through an one end of the second cover part 87. The first cover part 86 is rotatably supported on the first cover shaft 88. An opening/closing part 121 for covering or exposing the access opening 6 is provided on one end of the first cover part 86. An operating part 122 for operating coupling arms 95 described later is provided on the other end of the first cover part 86. A depression 91 is formed on the lower end of the first cover part 86 (operating part 122) for engaging with the coupling member 90 when the first cover part 86 and second cover part 87 are coupled together. The grip part 65 on the developer cartridge 22 can be exposed through the access opening 6 by opening only the first cover part 86.

The second cover part 87 is rotatably supported on a second cover shaft 89 that extends in the widthwise direction along the lower edge of the access opening 6. By rotating the first cover part 86 and second cover part 87 open about the second cover shaft 89, it is possible to expose both the grip part 65 of the developer cartridge 22 and a drum grip part 93 described later through the access opening 6.

The coupling member 90 is formed in the shape of a crank when viewed from the side. The coupling member 90 is attached to the second cover part 87. The solenoid 97 can move the coupling member 90 toward the first cover part 86 to a position in which the end of the coupling member 90 engages in the depression 91 of the first cover part 86, and toward the second cover shaft 89 to a position in which the end of the coupling member 90 separates from the depression 91. When the end of the coupling member 90 is engaged in the depression 91, the first cover part 86 and second cover part 87 can be opened together as a unit. When the end of the coupling member 90 is separated from the depression 91, the first cover part 86 can be opened alone while the second cover part 87 remains closed.

The laser printer 301 also includes an extension part 92, the drum grip part 93 mentioned above, pivoting shafts 94, the coupling arms 95, double-ended extension parts 123, and depressions 96. The extension part 92 extends forward from the bottom front surface of the drum cartridge 21 and spans the widthwise direction. The drum grip part 93 extends downward from the front edge of the extension part 92. The pivoting shafts 94 protrude outward in the widthwise direction from both widthwise ends of the extension part 92. The coupling arms 95 are pivotably supported on each pivoting shaft 94. The double-ended extension parts 123 are disposed at a position opposing the coupling arm 95 vertically on both widthwise ends of the casing 33. The depressions 96 are formed in the bottom edge of the double-ended extension part 123. A protrusion 96*a* is formed on the front edge of the depression 96.

The coupling arm 95 has an L-shape in a side view and is integrally formed of a pivoting part 124 extending in the front-to-rear direction, and an engaging part 125 extending upward from the rear end of the pivoting part 124. The pivoting shaft 94 is inserted through the center portion of the pivoting part 124 with respect to the longitudinal direction thereof. By pivoting the coupling arm 95 about the pivoting shaft 94, the engaging part 125 can be engaged in or separated from the depression 96 of the developer cartridge 22. In addition, an arm-urging spring (not shown) constantly urges the coupling arm 95 in a direction for engaging the engaging part 125 in the depression 96 (clockwise in FIGS. 5 and 6). The drum cartridge 21 and developer cartridge 22 are coupled together by engaging the engaging part 125 with the protrusion 96*a*.

In the laser printer 301 of the third embodiment, the CPU 79 controls the solenoid 97 based on whether an empty signal has been inputted from the sensor 44. The CPU 79 controls the solenoid 97 to move the coupling member 90 in a direction for engaging with or separating from the depression 91.

When the sensor 44 has not inputted an empty signal into the CPU 79, the solenoid 97 is in a non-operating state. Therefore, the end of the coupling member 90 is engaged in the depression 91 of the first cover part 86, enabling the first cover part 86 and second cover part 87 to be opened together. At this time, since the engaging part 125 of the coupling arm 95 is engaged in the depression 96 of the developer cartridge 22, the drum cartridge 21 and developer cartridge 22 are engaged by the coupling arm 95 and double-ended extension part 123.

When the toner accommodated in the toner-accommodating chamber 38 drops below the prescribed amount, the sensor 44 inputs an empty signal into the CPU 79. Upon receiving the inputted empty signal, the CPU 79 operates the solenoid 97, and the solenoid 97 separates the end of the coupling member 90 from the depression 91. As a result, the first cover part 86 and second cover part 87 are disengaged, enabling the user to open only the first cover part 86 while the second cover part 87 remains closed. When opening the first cover part 86, the operating part 122 of the first cover part 86 contacts the front edge of the coupling arm 95 from below and lifts the front edge of the coupling arm 95 upward. As a result, the coupling arm 95 pivots about the pivoting shaft 94 counterclockwise, as shown in FIG. 6, separating the engaging part 125 of the coupling arm 95 from the depression 96 and disengaging the drum cartridge 21 and developer cartridge 22 from the engagement provided by the coupling arm 95.

Hence, when the toner-accommodating chamber 38 reaches an empty state, that is, when the amount of toner drops below a prescribed amount, the coupled movement of the first cover part 86 and second cover part 87 is disengaged. Accordingly, it is possible to open only the first cover part 86 so that the grip part 65 of the developer cartridge 22 is exposed from the access opening 6, but the drum grip part 93 of the drum cartridge 21 is not exposed. Hence, if the user grips the grip part 65 and pulls the process cartridge 15, the developer cartridge 22 can be removed from the main casing 2 while the drum cartridge 21 remains therein. As a result, the laser printer 301 can reliably prevent the user from mistakenly replacing both the drum cartridge 21 and developer cartridge 22 together when only the developer cartridge 22 need be replaced.

Further, by providing this simple construction including the first cover part 86 and second cover part 87, it is possible to reliably expose only the grip part 65 of the developer cartridge 22 when the developer cartridge 22 must be removed from the main casing 2 by itself. Hence, this construction reliably prevents the drum cartridge 21 from being removed together with the developer cartridge 22.

Further, when it is necessary to remove the developer cartridge 22 from the main casing 2 alone, the first cover part 86 and second cover part 87 can be disengaged by separating the end of the coupling member 90 from the depression 91. As a result, only the first cover part 86 is opened so that only the grip part 65 of the developer cartridge 22 is exposed. Therefore, this construction more reliably prevents the drum cartridge 21 from being removed together with the developer cartridge 22.

In addition, as the first cover part 86 is opened, the engagement between the drum cartridge 21 and developer cartridge 22 implemented by the coupling arm 95 is released. Hence, after opening the first cover part 86, the user can grip the grip part 65 of the developer cartridge 22 and remove the developer cartridge 22 from the main casing 2 while leaving the drum cartridge 21 therein. However, when both the first cover part 86 and second cover part 87 are opened together, the drum cartridge 21 and developer cartridge 22 remain coupled together by the coupling arm 95. Therefore, the user can grip the grip part 65 and remove the drum cartridge 21 together with the developer cartridge 22 from the main casing 2.

Further, the developer cartridge 22 and drum cartridge 21 can be removed together from the main casing 2 by gripping the drum grip part 93, which is also exposed in the access opening 6. Hence, when replacing only the developer cartridge 22, the developer cartridge 22 can be removed alone from the main casing 2; and when it is necessary to replace both the drum cartridge 21 and the developer cartridge 22, the drum cartridge 21 can be removed together with the developer cartridge 22.

Further, the drum cartridge 21 is coupled with the developer cartridge 22 by engaging the engaging part 125 of the coupling arm 95 in the depression 96 of the developer cartridge 22. While opening the first cover part 86, the operating part 122 of the first cover part 86 manipulates the coupling arm 95 so that the engaging part 125 of the coupling arm 95 disengages from the depression 96, thereby disengaging the drum cartridge 21 and developer cartridge 22. Accordingly, this construction can reliably engage and disengage the drum cartridge 21 and developer cartridge 22.

Next, a laser printer according to a fourth embodiment of the present invention will be described with reference to FIGS. 7 and 8, wherein like parts and components in the described embodiments are designated with the same reference numerals to avoid duplicating description.

Figure 7:
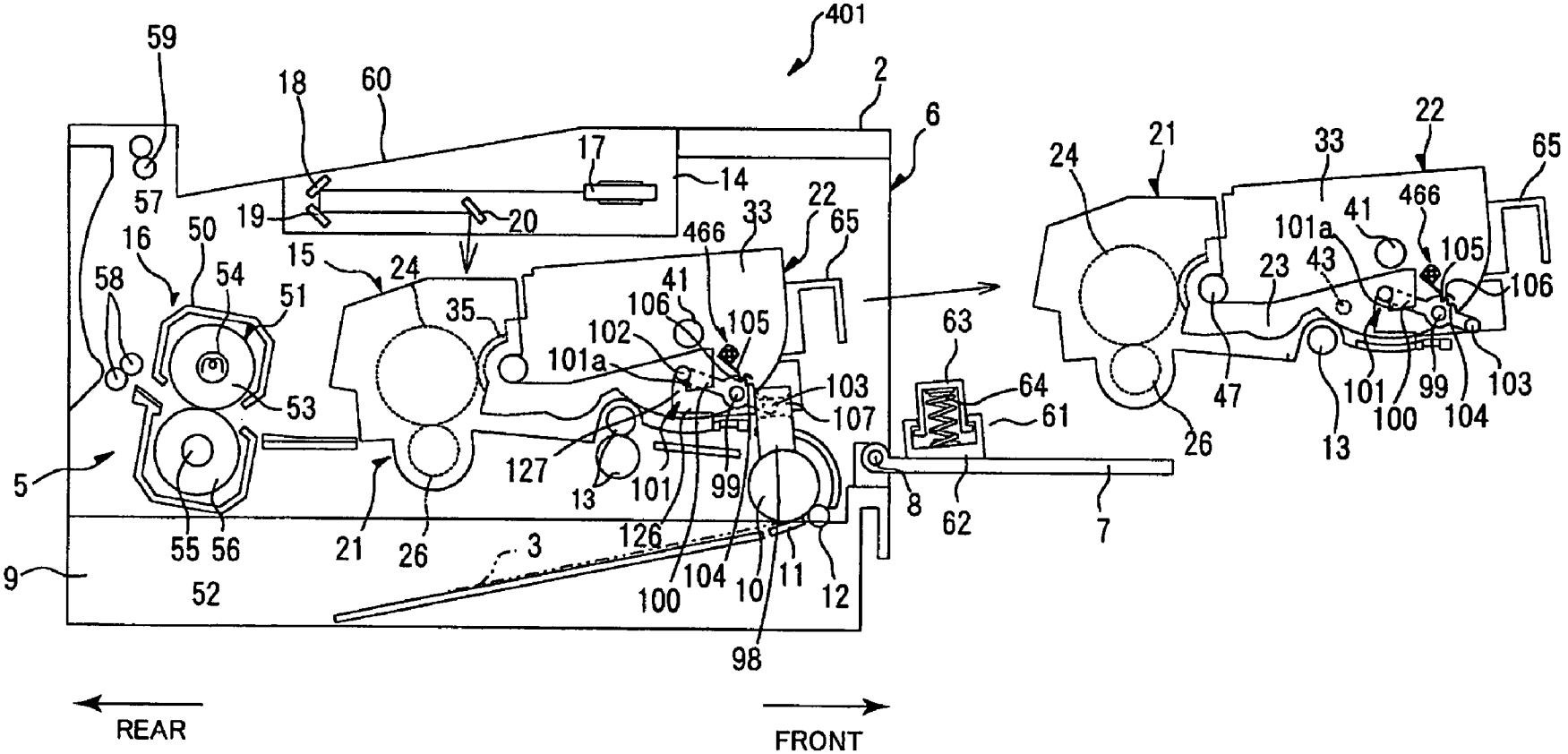
FIG. 7 is a cross-sectional view showing a laser printer according to a fourth embodiment of the present invention, wherein the developer cartridge and the drum cartridge have been removed together from the main casing.
Figure 8:
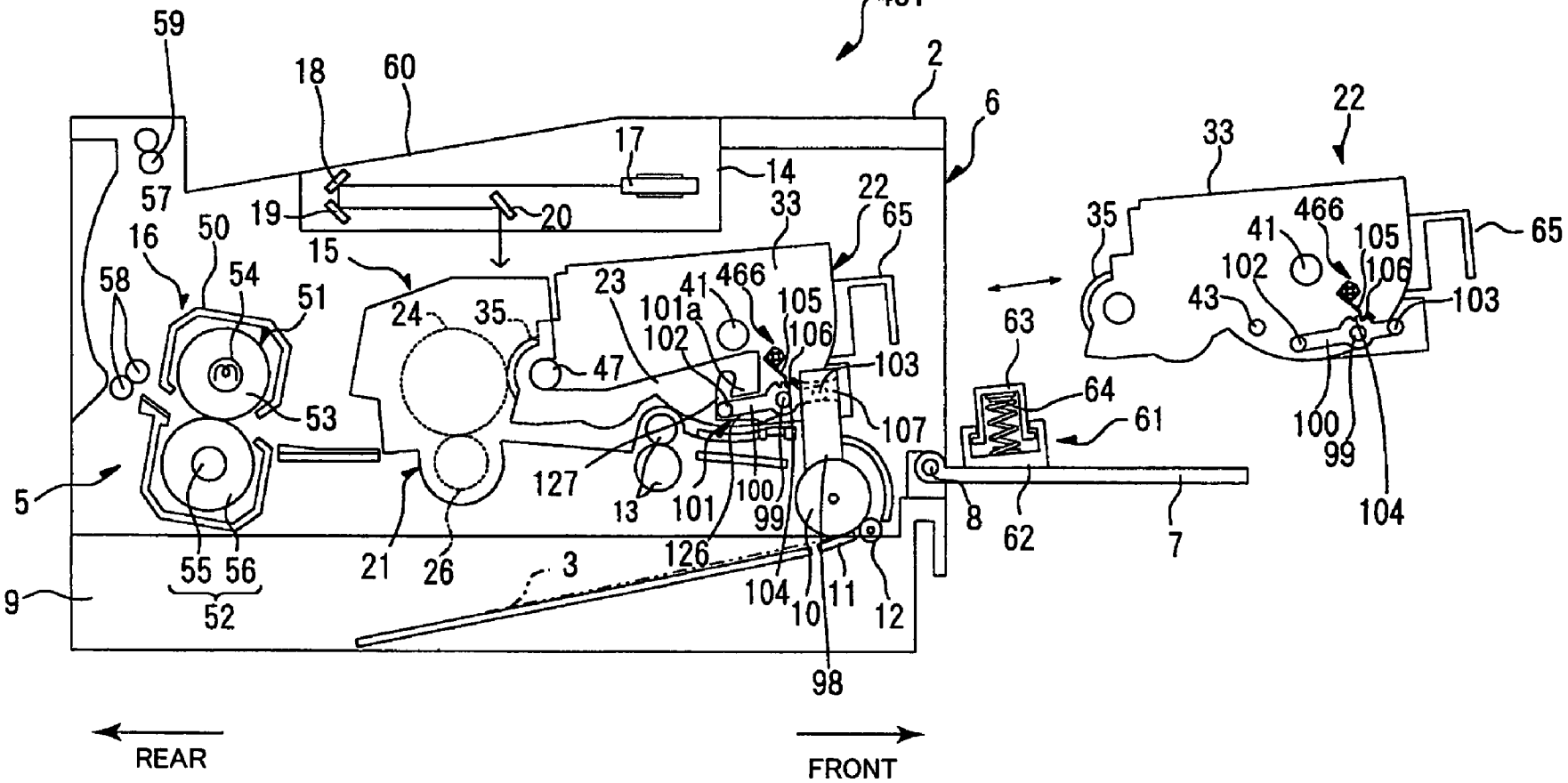
FIG. 8 is a cross-sectional view of the laser printer in FIG. 7, wherein the developer cartridge has been removed from the main casing by itself while the drum cartridge remains in the main casing.

FIGS. 7 and 8 show the construction of a laser printer 401 according to the fourth embodiment. In the laser printer 401 of the fourth embodiment, the coupling mechanism 66 includes pivoting shafts 99, coupling arms 100, and engaging grooves 101. The pivoting shafts 99 are provided on the lower front side of the casing 33 at both widthwise ends and protrudes outward in the widthwise direction. The coupling arms 100 are pivotably supported on each pivoting shaft 99. The engaging grooves 101 are formed in a substantial L-shape on the front end of both side plates 23. Protrusions 101*a* are formed on the front edge of the engaging groove 101 on both side plates 23.

The engaging groove 101 includes an introduction part 126 extending rearward from the front edge of each side plate 23, and a fitting part 127 extending upward from the rear end of the introduction part 126. Each coupling arm 100 extends in the front-to-rear direction. The center portion of the coupling arm 100 in the front-to-rear direction protrudes in a circular arc in a direction orthogonal to the longitudinal direction. The pivoting shaft 99 is inserted through the central portion of this arc-shaped protrusion of the coupling arm 100. Two V-shaped grooves 104 are formed on the upper edge of the coupling arm 100 in the central region. Engaging protrusions 102 are provided on the rear end of each coupling arm 100 for engaging with the engaging groove 101. The engaging protrusion 102 extends outward in the widthwise direction. An insertion boss 103 is provided on the front end of each coupling arm 100, extending outward in the widthwise direction. The insertion boss 103 is inserted into an operating groove 107 of an actuator 98 described later.

Click springs 105 are provided above each coupling arm 100. One end of the click spring 105 is fixed to the respective side surface of the casing 33 by a screw. An opposing end 106 of the click spring 105 is bent back in an approximate V-shape so that the end 106 can be selectively engaged in one of the grooves 104. When the end 106 of the click spring 105 is engaged in a first groove 104, the coupling arms 100 are maintained in a position (the position shown in FIG. 7) whereby the engaging protrusion 102 is fitted into the top end of the fitting part 127. By engaging the engaging protrusion 102 with the protrusion 101*a*, the drum cartridge 21 and developer cartridge 22 are integrally linked together. When the end 106 of the click spring 105 is fitted into a second groove 104, the coupling arms 100 are maintained in a position (the position shown in FIG. 8) whereby the engaging protrusion 102 is positioned on the rear end of the introduction part 126.

The laser printer 401 is also provided with the actuator 98 mentioned earlier for pivoting each of the coupling arms 100 about the respective pivoting shafts 99. When the process cartridge 15 is mounted in the main casing 2, the actuator 98 opposes the outer widthwise side of the insertion boss 103. The operating groove 107 is formed in the actuator 98 in the front-to-rear direction. When the process cartridge 15 is mounted in the main casing 2, the end of the insertion boss 103 can be inserted in the operating groove 107. The actuator 98 is capable of moving reciprocatingly up and down. When the actuator 98 drops to its lower most position while the end of the insertion boss 103 is inserted in the operating groove 107, the coupling arm 100 pivots clockwise in FIG. 8. At this time, the engaging protrusion 102 of the coupling arm 100 is positioned at the top end of the fitting part 127, as shown in FIG. 7.

On the contrary, when the actuator 98 rises to its uppermost position, the coupling arm 100 pivots counterclockwise in FIG. 7 so that the engaging protrusion 102 is positioned on the rear end of the introduction part 126, as shown in FIG. 8. If the user pulls the developer cartridge 22 forward at this time, the engaging protrusion 102 is pulled out of the engaging groove 101 through the introduction part 126, while the insertion boss 103 is pulled out of the operating groove 107. Accordingly, the developer cartridge 22 can be removed from the main casing 2 while the drum cartridge 21 remains therein.

In the laser printer 401 of the preferred embodiment described above, when the amount of toner accommodated in the toner-accommodating chamber 38 is greater than or equal to the prescribed amount, the actuator 98 is lowered to its lowermost position, whereby the coupling arm 100 (coupling mechanism 66) can maintain engagement between the drum cartridge 21 and developer cartridge 22. Accordingly, the drum cartridge 21 can be removed from the main casing 2 together with the developer cartridge 22.

However, if the toner-accommodating chamber 38 becomes empty, that is, if the amount of toner in the toner-accommodating chamber 38 drops below the prescribed amount, then the actuator 98 is raised to its uppermost position, whereby the link between the drum cartridge 21 and developer cartridge 22 provided by the coupling arm 100 is disengaged. Hence, the developer cartridge 22 can be removed from the main casing 2 by itself, while the drum cartridge 21 remains therein. As a result, the laser printer 401 of the preferred embodiment can reliably prevent the user from mistakenly replacing both the drum cartridge 21 and developer cartridge 22 when only the developer cartridge 22 needs replacing.

Next, a laser printer according to a fifth embodiment of the present invention will be described with reference to FIGS. 9 and 10, wherein like parts and components in the described embodiments are designated with the same reference numerals to avoid duplicating description.

Figure 9:
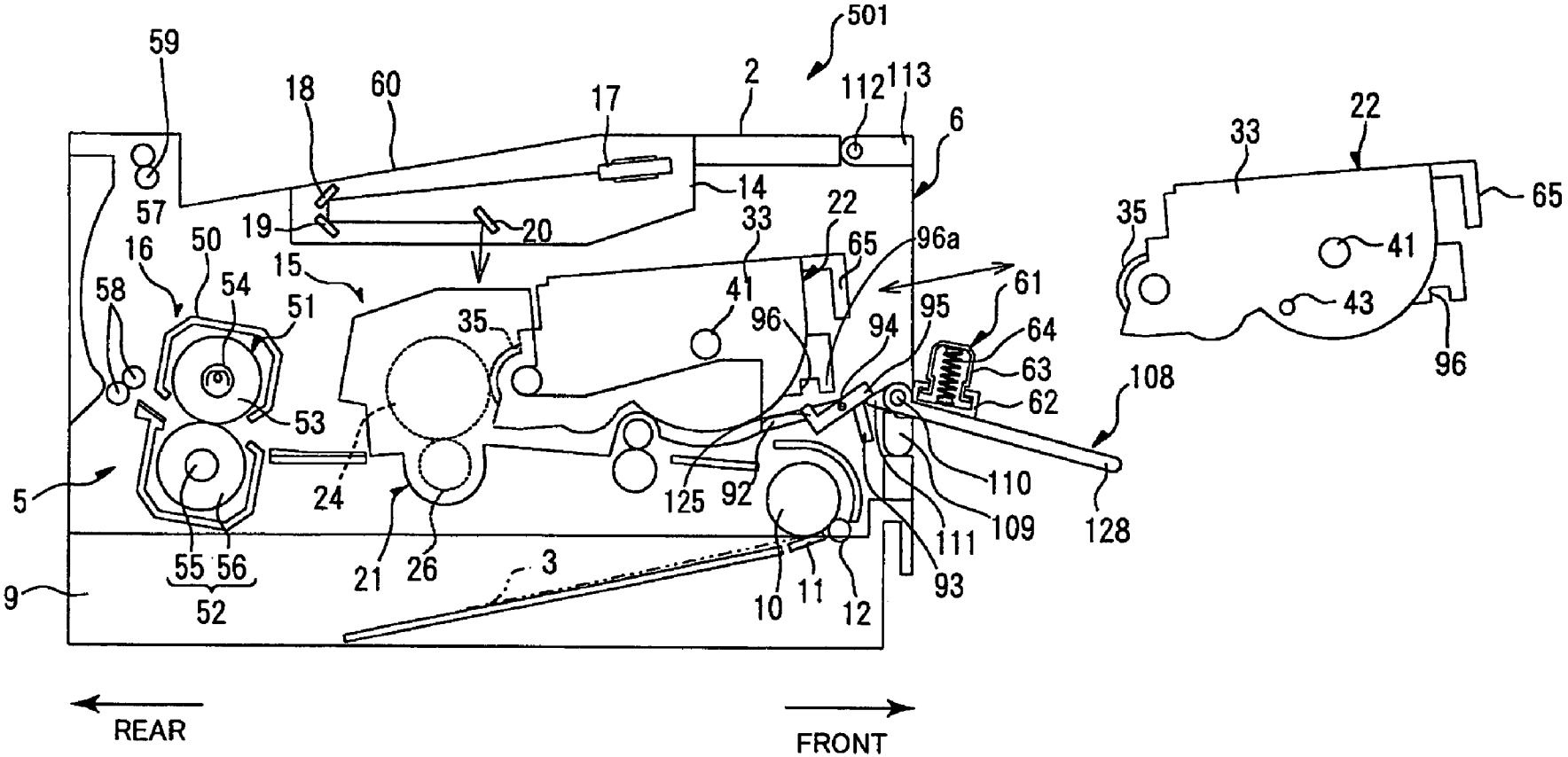
FIG. 9 is a cross-sectional view showing a laser printer according to a fifth embodiment of the present invention, wherein the developer cartridge and the drum cartridge have been removed together from the main casing.
Figure 10:
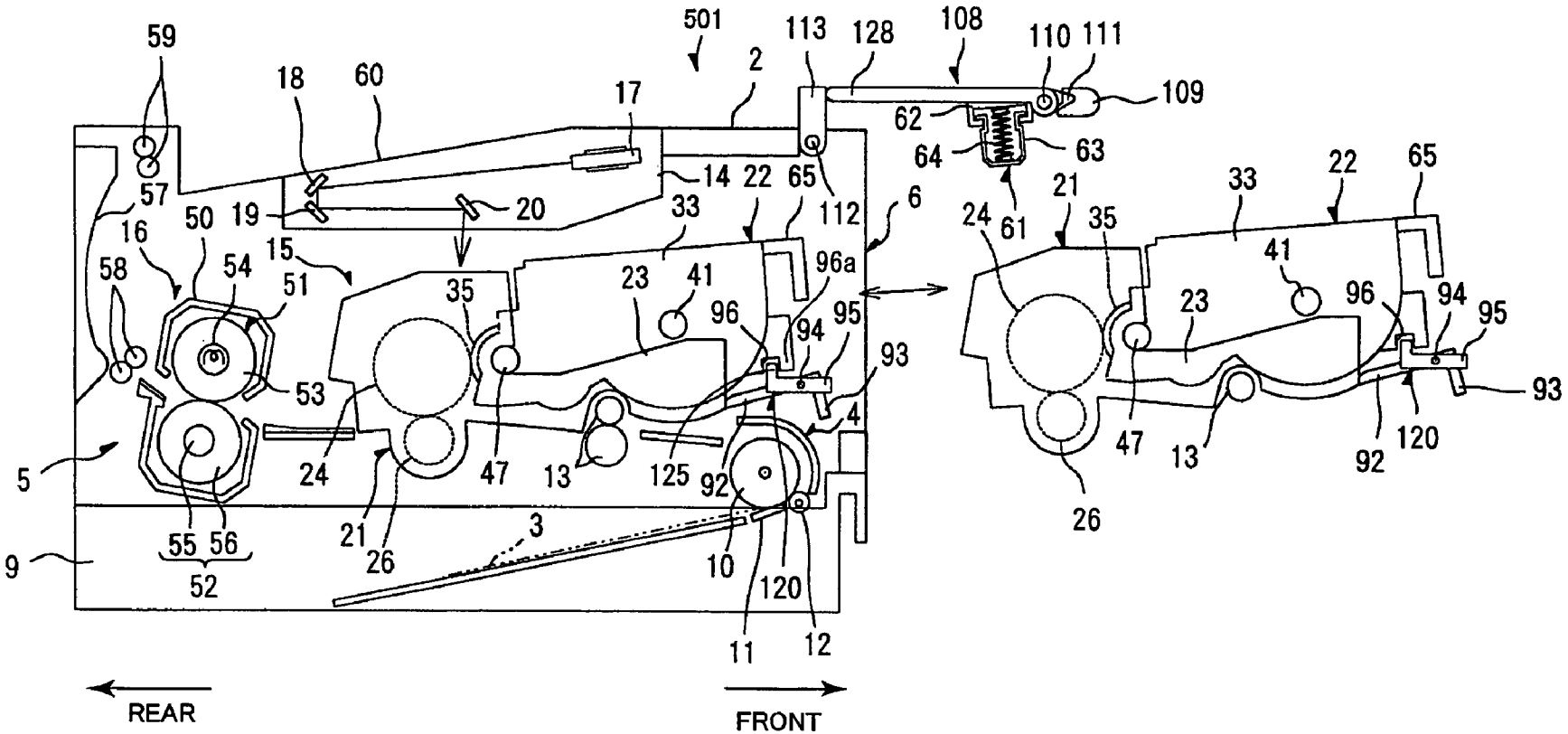
FIG. 10 is a cross-sectional view of the laser printer in FIG. 9, wherein the developer cartridge has been removed from the main casing by itself while the drum cartridge remains in the main casing.

FIGS. 9 and 10 show the structure of a laser printer 501 according to the fifth embodiment. In the laser printer 501 of the fifth embodiment, the front cover 7 includes a first cover part 108, and a second cover part 109 disposed below the first cover part 108 when the front cover 7 is closed over the access opening 6. The laser printer 501 also has a display unit (not shown). A first cover shaft 110 extending in the widthwise direction is inserted through a bottom end of the first cover part 108. The first cover part 108 is rotatably supported on the first cover shaft 110. The first cover part 108 includes an opening/closing part 128 on one end for covering or exposing the access opening 6, and an operating unit 111 disposed on the other end for manipulating the coupling arm 95. The operating unit 111 has a substantially triangular shape in a side view. When the first cover part 108 is rotated open about the first cover shaft 110, the grip part 65 of the developer cartridge 22 can be exposed in the access opening 6.

The second cover part 109 is capable of linking with the operating unit 111 on the first cover part 108 and can also separate from the main casing 2. The laser printer 501 also has an upper cover 113 disposed on the upper front end of the main casing 2. The upper cover 113 is rotatably supported on an upper cover shaft 112 that extends in the widthwise direction. The upper cover 113 is configured so that its front end can link with the top end of the first cover part 108. By linking the top end of the first cover part 108 in the front end of the upper cover 113 and linking the operating unit 111 of the first cover part 108 in the second cover part 109, it is possible to rotate the upper cover 113, first cover part 108, and second cover part 109 open as a unit about the upper cover shaft 112. By opening the upper cover 113, first cover part 108, and second cover part 109 as a unit, both the grip part 65 of the developer cartridge 22 and the drum grip part 93 of the drum cartridge 21 can be exposed in the access opening 6.

With this construction, when the amount of toner in the toner-accommodating chamber 38 is greater than or equal to the prescribed amount, a message indicating that the upper cover 113, first cover part 108, and second cover part 109 can be opened together is displayed on the display unit. Upon reading this message, the user opens the upper cover 113, first cover part 108, and second cover part 109, exposing both the grip part 65 and the drum grip part 93 in the access opening 6. By gripping and pulling on the drum grip part 93, the user can remove both the drum cartridge 21 and developer cartridge 22 from the main casing 2. Further, since the drum cartridge 21 and developer cartridge 22 are coupled together by the coupling arm 95, the drum cartridge 21 can be removed from the main casing 2 together with the developer cartridge 22.

When the amount of toner in the toner-accommodating chamber 38 drops below the prescribed amount so that the toner-accommodating chamber 38 enters an empty state, a message indicating that only the first cover part 108 can be opened is displayed on the display unit. Viewing this message, the user opens the first cover part 108. As the first cover part 108 is opened, the operating unit 111 contacts the front end of the coupling arm 95 from below, raising the front end of the coupling arm 95 upward.

As a result, the coupling arm 95 pivots counterclockwise about the pivoting shaft 94, as shown in FIG. 9, causing the engaging part 125 of the coupling arm 95 to separate from the depression 96 of the developer cartridge 22 and removing the link between the drum cartridge 21 and developer cartridge 22 provided by the coupling arm 95. Since only the grip part 65 of the developer cartridge 22 is exposed in the access opening 6 at this time, the user can grip the grip part 65 and reliably remove the developer cartridge 22 by itself from the main casing 2, while the drum cartridge 21 remains therein. This construction reliably prevents the user from mistakenly replacing both the developer cartridge 22 and the drum cartridge 21 when only the developer cartridge 22 need be replaced.

What is claimed is:

1. An image-forming apparatus comprising:

a main body;

an image-carrying member cartridge disposed inside the main body and having an image-carrying member;

a developer cartridge disposed inside the main body and supplying a developer to the image-carrying member; and a removal preventing unit disposed inside the main body;

wherein the developer cartridge can selectively be mounted into or removed from the main body together with the image-carrying member cartridge, or mounted into or removed from the main body alone while the image-carrying member cartridge remains mounted in the main body;

wherein the removal preventing unit detects a state in which only the developer cartridge need be removed and prevents the removal of the image-carrying member cartridge from the main body based on the detection.

2. The image-forming apparatus as claimed in claim 1, further comprising a coupling unit that couples the image-carrying member cartridge with the developer cartridge so that both the image-carrying member cartridge and the developer cartridge are mounted and removed together as a unit with respect to the main body;

wherein the removal preventing unit comprises:

a detecting member that detests a state in which only the developer cartridge need be removed from the main body; and a disengaging member that releases an engagement between the image-carrying member cartridge and the developer cartridge by the coupling unit when the detecting member detects that only the developer cartridge need be removed.

3. The image-forming apparatus as claimed in claim 2, wherein the coupling unit comprises:

a first engaging part provided on one of the image-carrying member cartridge and the developer cartridge; and a second engaging part provided on another one of the image-carrying member cartridge and the developer cartridge, the second engaging part engaging with the first engaging part.

4. The image-forming apparatus as claimed in claim 3, wherein the second engaging part is a protrusion formed on the developer cartridge;

the first engaging part is a coupling arm provided on the image-carrying member cartridge and engages with the protrusion; and the disengaging member comprises an actuator that releases an engagement between the coupling arm and the protrusion when the detecting member detects the state in which only the developer cartridge need be removed.

5. The image-forming apparatus as claimed in claim 4, further comprising a pivoting shaft;

wherein the coupling arm is pivotably disposed on the pivoting shaft and comprises an engaging protrusion on one end of the coupling arm, the engaging protrusion engaging with the protrusion of the second engaging part; and the actuator separates the engaging protrusion from the protrusion by pressing the other end of the coupling arm so that the coupling arm pivots about the pivoting shaft.

6. The image-forming apparatus as claimed in claim 3, wherein the second engaging part is a protrusion formed on the image-carrying member cartridge;

the first engaging part is a coupling arm provided on the developer cartridge and engages with the protrusion; and the disengaging member comprises an actuator that releases the engagement between the coupling arm and the protrusion when the detecting member detects the state in which only the developer cartridge need be removed.

7. The image-forming apparatus as claimed in claim 2, wherein the coupling unit transmits a force to the image-carrying member cartridge when the force is applied to the developer cartridge and removes the developer cartridge from the main body while the developer cartridge and image-carrying member cartridge are coupled together.

8. The image-forming apparatus as claimed in claim 2, wherein the disengaging member is disposed on the main body.

9. The image-forming apparatus as claimed in claim 2, wherein the detecting member detects that the developer cartridge is in an empty state.

10. The image-forming apparatus as claimed in claim 1, further comprising a cover member;

wherein the developer cartridge comprises a first grip part that is gripped when removing the developer cartridge from the main body;

the image-carrying member cartridge is capable of supporting the developer cartridge and comprises a second grip part that is gripped when removing the image-carrying member cartridge and developer cartridge together from the main body;

the removal preventing unit comprises a detecting member that detects a state in which only the developer cartridge need be removed from the main body; and the cover member is disposed on the main body and capable of opening to expose the first grip part when the detecting member detects the state in which only the developer cartridge need be removed.

11. The image-forming apparatus as claimed in claim 10, wherein the cover member comprises:

a first cover part that is opened to expose only the first grip part; and a second cover part that is opened with the first cover part to expose the second grip part;

wherein only the first cover part can be opened when the detecting member detects the state in which only the developer cartridge need be removed.

12. The image-forming apparatus as claimed in claim 11, further comprising an actuator that enables the first cover part and second cover part to be opened together;

wherein the removal preventing unit comprises a cover interlock releasing member that releases an interlocked state between the first cover part and the second cover part achieved by the actuator when the detecting member detects the state in which only the developer cartridge need be removed.

13. The image-forming apparatus as claimed in claim 10, further comprising:

a coupling unit that couples the image-carrying member cartridge and the developer cartridge so that both the image-carrying member cartridge and the developer cartridge can be mounted and removed together as a unit with respect to the main body; and a disengaging member that removes the engagement between the image-carrying member cartridge and developer cartridge achieved by the coupling unit as the cover member is opened.

14. The image-forming apparatus as claimed in claim 13, wherein the coupling unit comprises:

a protrusion provided on the developer cartridge; and a coupling arm disposed on the image-carrying member cartridge, the coupling arm engaging with the protrusion;

wherein the cover member comprises a first cover part that opens to expose only the first grip part, the first cover part having a rotational axis;

the first cover part is provided on the main body so as to rotate about the rotational axis and comprises an opening/closing part on one end of the first cover part, the opening/closing part moves between a state of exposing and a state of covering the first grip part when the first cover part opens and closes about the rotational axis, respectively; and the disengaging member comprises an operating protrusion provided on another end of the first cover part, the operating protrusion manipulating the coupling arm as the first cover part is opened to disengage the coupling arm from the protrusion.

15. An image-forming apparatus comprising:

a main body;

an image-carrying member cartridge disposed inside the main body and having an image-carrying member;

a developer cartridge disposed inside the main body and supplying a developer to the image-carrying member; and a cover member disposed on the main body;

wherein the developer cartridge can selectively be mounted into or removed from the main body together with the image-carrying member cartridge, or mounted into or removed from the main body alone while the image-carrying member cartridge remains mounted in the main body;

wherein the cover member allows the mounting and removal of only the developer cartridge while the image-carrying member cartridge remains mounted in the main body.

16. The image-forming apparatus as claimed in claim 15, wherein the cover member comprises:

a first cover part that allows the mounting and removal of only the developer cartridge; and a second cover part that allows the mounting and removal of both the image-carrying member cartridge and the developer cartridge as a unit.

17. The image-forming apparatus as claimed in claim 16, wherein the developer cartridge comprises a first grip part that is gripped when removing the developer cartridge from the main body;

the image-carrying member cartridge is capable of supporting the developer cartridge and comprises a second grip part that is gripped when removing the image-carrying member cartridge and developer cartridge together from the main body;

the first cover part opens to expose only the first grip part; and the second cover part opens with the first cover part to expose the second grip part.

18. An image-forming apparatus comprising:

a main body;

a first cartridge that is mountable to or removable from the main body;

a second cartridge including a chamber that accommodates a developing agent, the second cartridge being mountable to or removable from the first cartridge; and a removal preventing unit disposed inside the main body;

wherein the second cartridge can selectively be mounted into or removed from the main body together with the first cartridge, or mounted into or removed from the casing alone while the first cartridge remains mounted in the main body;

wherein the removal preventing unit detects a state in which only the second cartridge need be removed and prevents the removal of the first cartridge from the casing based on the detection.

19. The image-forming apparatus as claimed in claim 18, wherein the first cartridge includes a photosensitive member.

20. The image-forming apparatus as claimed in claim 18, wherein the second cartridge includes a developing roller that holds the developing agent thereon.

* * * * *